United States Patent [19]

Roberts

[11] 4,313,233

[45] Feb. 2, 1982

[54] WATERLESS FLUSH TOILET SYSTEM

[75] Inventor: George C. Roberts, Los Angeles, Calif.

[73] Assignee: Inca-One Corporation, Los Angeles, Calif.

[21] Appl. No.: 161,575

[22] Filed: Jun. 20, 1980

Related U.S. Application Data

[63] Continuation-in-part of Ser. No. 7,146, Jan. 29, 1979, Pat. No. 4,222,130.

[51] Int. Cl.[3] ..... E03D 1/00; E03D 9/10

[52] U.S. Cl. ..... 4/321; 4/317; 4/318; 4/398; 4/DIG. 11; 4/DIG. 19

[58] Field of Search ..... 4/318, 317, 213, DIG. 11, 4/DIG. 19, 321, 355, 398

[56] References Cited

U.S. PATENT DOCUMENTS

| | | | |
|---|---|---|---|
| 1,303,358 | 5/1919 | Montgomery | 4/317 |
| 3,628,196 | 12/1971 | Quiram et al. | 4/318 |
| 3,633,218 | 1/1972 | Lekberg | 4/317 X |
| 3,673,614 | 7/1972 | Claunch | 4/317 X |
| 3,751,735 | 8/1973 | Sargent et al. | 4/318 |
| 3,829,909 | 8/1974 | Rod et al. | 4/318 |
| 3,839,745 | 10/1974 | Bramall | 4/318 |
| 3,905,049 | 9/1975 | Stokes | 4/317 |
| 3,922,730 | 12/1975 | Kemper | 4/317 X |
| 3,934,275 | 1/1976 | Bishton, Jr. | 4/317 |
| 3,942,200 | 3/1976 | Pearson | 4/213 X |
| 4,070,714 | 1/1978 | Bishton | 4/318 |

*Primary Examiner*—Henry K. Artis

*Attorney, Agent, or Firm*—Blakely, Sokoloff, Taylor & Zafman

[57] ABSTRACT

A waterless flush toilet system comprising a toilet and a gravity fed waste holding tank. The system utilizes a recirculating nonaqueous flushing fluid which is stored within the holding tank. The fluid, which is lighter than the waste material and insoluble therein, forms a stratified layer on the surface of the material. A float having a flushing fluid inlet floats within the layer of fluid, separated from solid waste matter by a tubular screen member, the float being suspended from the top of the tank by a flexible coiled hose which is coupled to the fluid inlet. The coiled hose contracts as the waste level in the tank rises, thereby permitting the float to remain within the flushing fluid layer regardless of the waste material level. When the toilet is flushed, an air-powered pump draws a fraction of the fluid into the fluid inlet of the float, through the flexible hose and finally to the toilet. The fluid serves as a medium for transporting the waste material from the toilet to the holding tank. When the fluid is flushed into the tank, it separates from the waste material and returns to the stratified layer for reuse. An exhaust system utilizes a double-walled toilet to prevent exhausting of fluid or waste matter.

16 Claims, 9 Drawing Figures

WATERLESS FLUSH TOILET SYSTEM

This is a continuation-in-part of co-pending application Ser. No. 007,146, filed Jan. 29, 1979 now U.S. Pat. No. 4,222,130.

BACKGROUND OF THE INVENTION

1. Field of the Invention

This invention pertains to the field of waste disposal and, more particularly, to the field of closed cycle waterless flush toilet system.

2. Prior Art

There are many sanitation requirements which cannot be met by conventional sanitation solutions. For example, many locations where sanitation facilities are needed do not have public sewers and cannot accommodate septic tanks because they are prohibited or impractical. Also, many such locations do not have an adequate supply of water to accommodate conventional water flush toilets.

There are existing waterless flush toilet systems that overcome many of the previously noted problems. A system manufactured by the Sarmax Corporation of Laguna Niguel, Calif. is typical of such systems. The Sarmax system comprises one or more flush toilets connected to a main holding tank, the tank being disposed at an elevation lower than that of the toilets. A supply of a nonaqueous flushing fluid comprised of a highly refined mineral oil and various additives is stored within the holding tank. The flushing fluid is lighter than and insoluble in the waste material which is also held in the tank. The fluid, therefore, tends to collect on the surface of the waste material so as to form a stratified layer thereon. A smaller quantity of the flushing fluid is also stored in individual "water closet"-type tanks positioned above each toilet.

When a toilet is flushed, a valve in the "water closet" is opened, permitting the fluid stored therein to enter the toilet and flush away the waste material. The fluid and waste material are fed by gravity to the main holding tank where the fluid separates from the waste material and becomes part of the stratified layer. When a toilet is being flushed, flushing fluid is simultaneously drawn up from the stratified layer in the tank to replace the fluid lost from the "water closet."

A fluid pickup device is disposed within the tank which floats within the surface layer of fluid regardless of the waste level within the tank. The float includes a plurality of fluid inlets which are connected to at least one flexible hose which exits through the top of the tank. A pump is used to draw the flushing fluid up through the pickup device fluid inlets, through the hose and then to the individual "water closets."

Once the tank becomes filled, a line from a vacuum pump truck is connected to the waste outlet located at the top of the tank. A pump down tube which is connected to the waste outlet extends from the top of the tank to the tank bottom, so that waste material is drawn up from the bottom through the tube into the pump truck. Not all of the waste material is removed during pump down. When the level of the waste and the flushing fluid strata drops to a predetermined point, automatic means prevents further pumping so that none of the flushing fluid is removed.

The presently existing waterless flush toilet systems solve many sanitation problems in locations where water flush toilets are not practical. However, such prior art systems possess many shortcomings. The Sarmax system, for example, is quite complex, utilizing electronic controls and the like. Furthermore, such systems are very bulky and not suitable for many applications, such as vehicles. A system is needed which is simple and does not incorporate complicated control means. Such a system would be more reliable than prior art systems and much less expensive. Furthermore, a system is needed which is compact and can be used in locations where space is at a premium, such as in buses or the like.

SUMMARY OF THE INVENTION

A waterless flush toilet system is disclosed comprising a toilet and a gravity-fed waste holding tank. The system utilizes a recirculating nonaqueous flushing fluid which is stored within the holding tank. The fluid, which is lighter than the waste material and insoluble therein, forms a stratified layer on the surface of the material. A float having a flushing fluid inlet floats within the layer of fluid, in a compartment formed by a tubular perforated screen member, separating solid waste matter from the fluid and liquid waste matter within the screen member, the float being suspended from the top of the tank by a flexible coiled hose which is coupled to the fluid inlet. The coiled hose contracts as the waste level rises, thereby permitting the float to remain within the flushing fluid layer regardless of the waste material level. When the toilet is flushed, an air-powered pump draws a fraction of the fluid into the fluid inlet of the float, through the flexible hose and finally to the toilet. The fluid serves as a medium for transporting the waste material from the toilet to the holding tank. When the fluid is flushed into the tank, it separates from the waste material and returns to the stratified layer for reuse. An exhaust system utilizes a double-walled toilet to prevent exhausting of fluid or waste matter.

The system includes a tubular perforated screen member which is disposed within the waste holding tank. The screen member, which extends from the tank top nearly to the bottom prevents lateral movement of the pickup float while permitting the float to move vertically to accommodate varying waste levels. The solid phase component of the waste matter which enters the tank by way of the waste inlet is prevented from traveling to the region of the tank enclosing the flushing pickup float by the perforated screen member. The screen member therefore acts as a partition which divides the interior of the tank into a solid and a liquid waste compartment. The solid waste compartment, which contains the waste inlet and waste outlet, contains the solid phase waste matter, a fraction of the liquid phase waste matter and a fraction of the flushing fluid. The liquid waste compartment, which includes the region of the tank where the pickup float is located, contains the remainder of the flushing fluid and liquid phase waste matter. This arrangement insures that the flushing fluid pickup float will not become clogged with solid waste matter. Furthermore, the pickup float is located in the liquid waste compartment and is, therefore, displaced from the waste inlet located in the solid waste compartment. Thus the fluid adjacent the pickup float will not be agitated by the waste matter when it is deposited into the tank, and therefore the fluid picked up by the float for flushing will be relatively free of solid waste matter.

The system further includes an exhaust fan and exhaust inlet and outlet ducting, connected to an outer wall of the toilet bowl or waste receiver at a level substantially above the level of an exit opening in an inner wall of the toilet, allowing vapors to be drawn through the toilet and the passageway between the inner and outer toilet walls, without venting flushing fluid or exhaust matter.

DETAILED DESCRIPTION OF THE INVENTION

Figure 1:
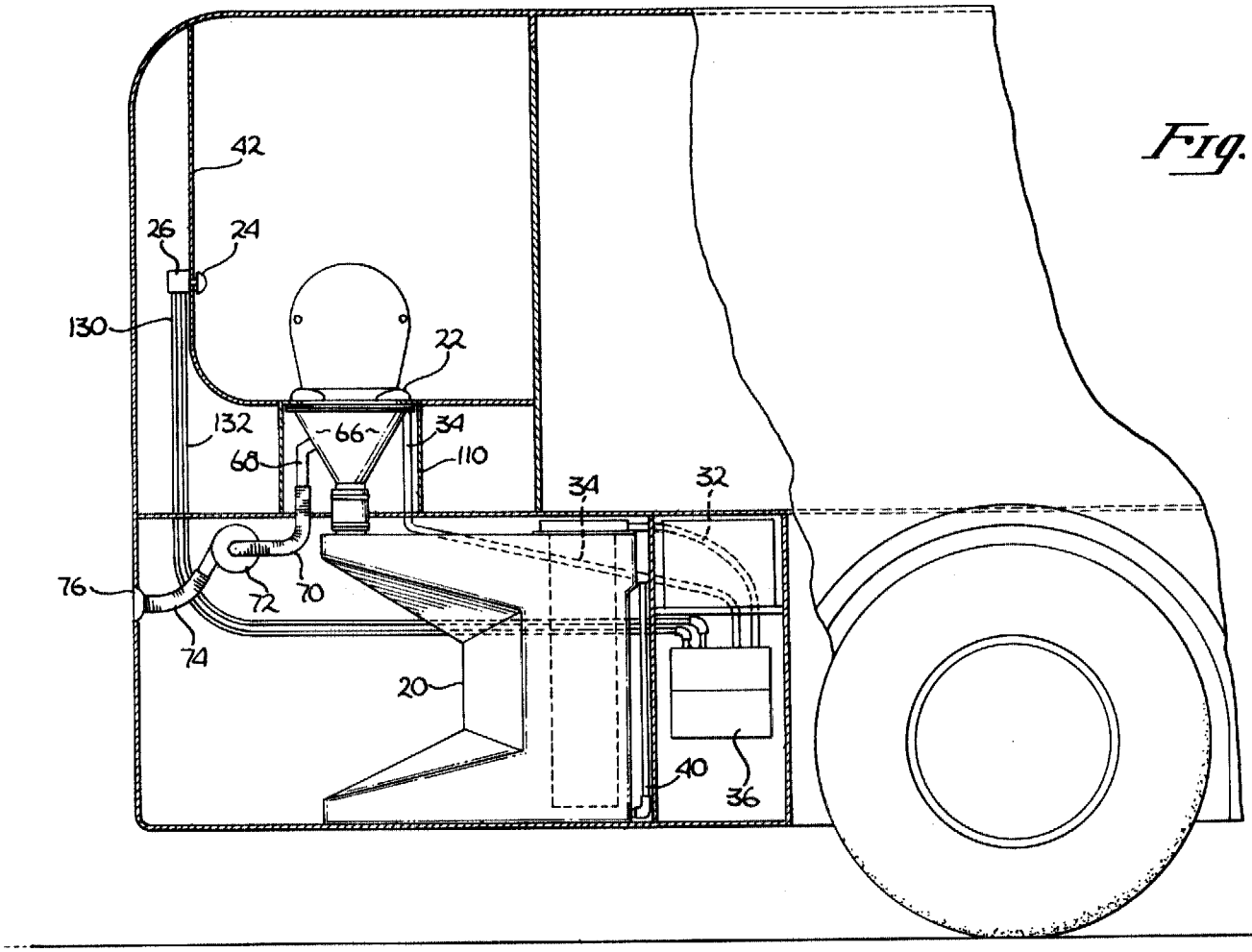
FIG. 1 is an elevational cut-away view of the toilet system situated in the rear section of a bus.

Referring now the the drawings, FIG. 1 shows a preferred embodiment of the subject invention. The invention includes a toilet generally indicated by the numeral 22. The toilet includes a toilet bowl 66, preferably made of sheet metal, although lighter weight materials such as plastics may be more suitable in mobile applications. Toilet bowl 66 is rigidly secured to a substantially level surface such as floor 30 by way of a bracket 110. Bracket 110 is in turn bolted or welded or otherwise securely fastened to floor 30.

Toilet bowl 66 is preferably double walled, having a toilet inner wall 60 and a toilet outer wall 62. Inner wall 60 is generally funnel-shaped and has an opening 65 at its lower extremity leading to an interstitial region 61 between the inner and outer walls, and inner wall 60 is attached at its upper extremity to bracket 110. Outer wall 62 is in turn attached to at its upper extremity to the upper extremity of inner wall 60.

Outer wall 62 is generally funnel-shaped, having a toilet exit pipe 116 extending from its lower extremity, and an exhaust opening 67 substantially above the level of opening 65, so that waste matter or flushing fluid will not be drawn into the exhaust opening 67.

FIG. 1 also shows the details of the toilet 22 gravity flow flushing mechanism. The mechanism includes a manually actuated flush button 24 passing through a toilet compartment wall 42, with the flushing button 24 attached to a pump switch 26. Waste holding tank 20 is shown as configured with a large trapezoidal indentation to accommodate the dimensions of a bus engine compartment and fittings. The toilet system is shown in FIG. 1 as it would be generally disposed in the rear of a bus.

A flushing fluid, to be described in greater detail below, is supplied to the toilet 22 by way of flushing fluid inlet line 34. The fluid is distributed around the upper periphery of the bowl 66 by a channel (not shown) formed in the bowl and is discharged into the bowl through at least one opening. The openings preferably direct the flushing fluid into the bowl at an angle so as to generate a swirling action which enhances the flushing process.

Figure 2:
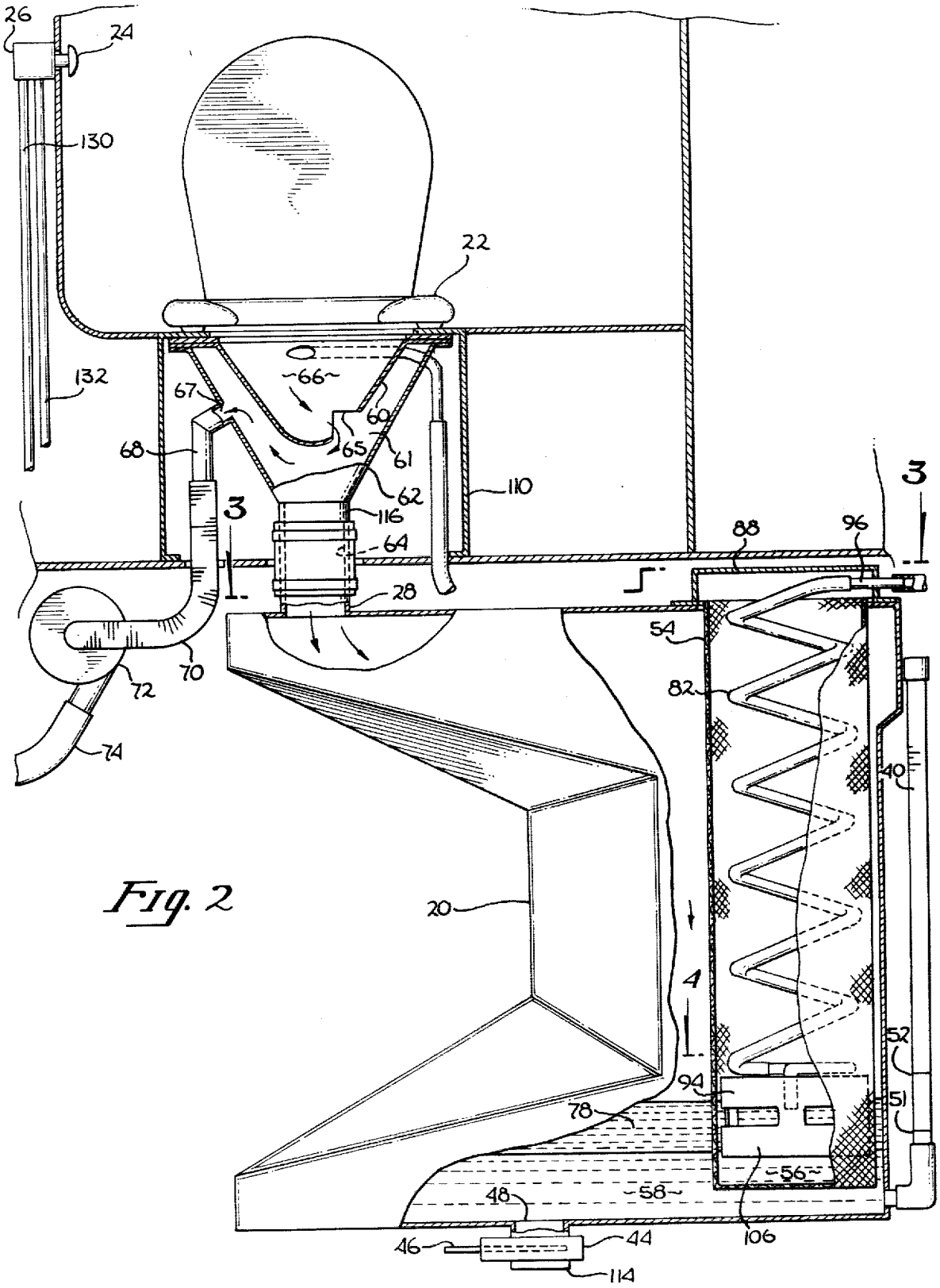
FIG. 2 is a detailed partial cross-sectional view showing the toilet system and waste holding tank.
Figure 3:
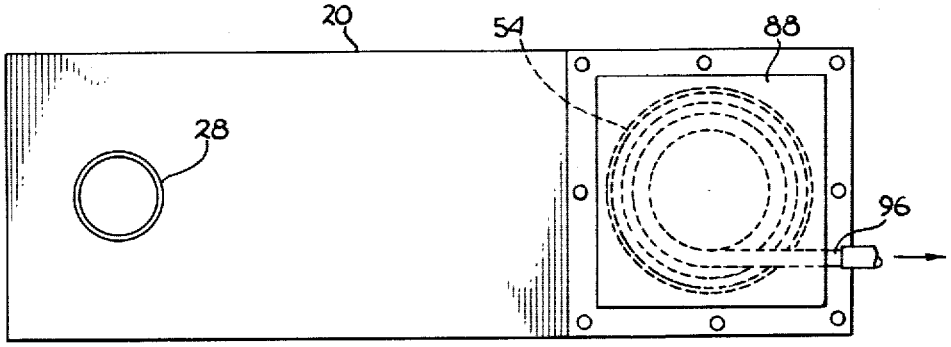
FIG. 3 is a cross-sectional top plan view of the waste holding tank taken along line 3—3 of FIG. 2.
Figure 4:
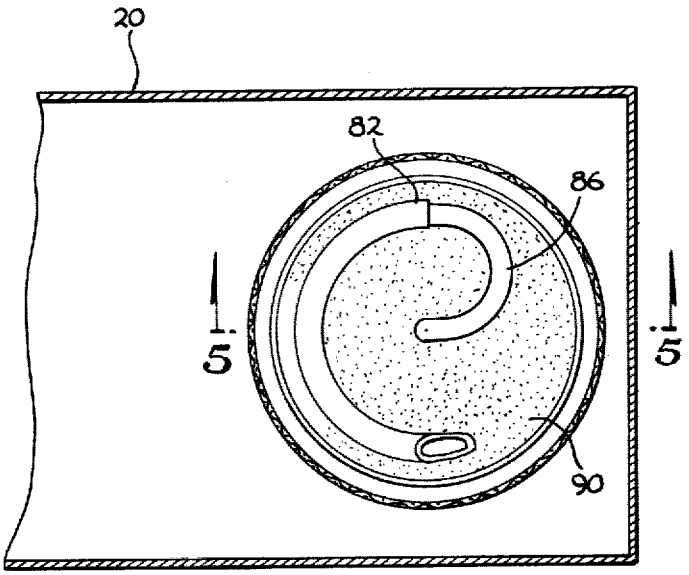
FIG. 4 is a fragmentary top view of the waste holding tank taken along line 4—4 of FIG. 2.

FIGS. 1 and 2 also show the system waste holding tank 20. The tank serves the two-fold purpose of storing the waste material and also separating the flushing fluid from such material. Tank 20 is preferably made of stainless steel, although other materials may be substituted. Any size tank may be used, with tanks having a capacity in the range of 20 to 25 gallons having been found suitable in applications on buses traveling long-distance routes. The tank 20 must be located at an elevation below that of toilet 22. The waste material and flushing fluid are conducted from toilet 22 to the tank by way of a toilet exit pipe 116 attached to the toilet which extends through an opening in floor 30. Pipe 116 is coupled to a conduit 64 which passes through the floor 30 and which is coupled to the waste inlet line 28 of the waste holding tank 20. Pipe 116 extends into the waste inlet line 28 to insure proper flow into the waste holding tank 20. A preferred means for exhausting air and vapors from the toilet 22 comprises a toilet bowl exhaust elbow 68 is connected to the toilet outer wall 62 at the exhaust opening 67 and is in turn connected to a toilet exhaust hose 70 which conveys air and vapors drawn from the toilet bowl 66 to the exhaust fan 72. Exhaust fan 72 is preferably an electrically activated motor in operation when the vehicle ignition is on. Exhaust fan 72 may alternatively be an air motor. Exhaust fan 72 is a preferred means for creating a vacuum to draw air and vapors from the toilet bowl 66, and exhausting such air and vapors into an exhaust exit hose 74 which is in turn connected to exhaust exit 76, an opening defined by the exterior surface of the vehicle, directing the toilet air and vapors outside the vehicle.

Referring now to FIG. 2, the details of the preferred embodiment holding tank 20 may be seen. The tank receives the flushing fluid and waste material from the toilet from a toilet exit pipe 116 mounted through the tank wall. The toilet exit pipe 116 is coupled to the waste inlet line 28 by the conduit 64. Directional flow arrows indicate the flow of waste materials as they enter the waste holding tank 20. Although the indentation of the tank 20 shown is designed to accommodate the space requirements of the situation of the toilet system near a bus engine, the edges of the indentation are sloped so as not to interfere with the flow of waste material into tank 20, while also giving maximum available capacity to the tank 20.

Perforated screen member 54 is tubular, closed at the lower end, open at upper end, and is attached at the upper end to a housing 88, attached to top of tank 20. The screen member 54 extends from the top of tank 20 down through the level of flushing fluid 78 in the tank 20, and approaches the bottom of tank 20. Screen member 54 is preferably fabricated from perforated sheet metal having $\frac{1}{8}$ inch openings staggered every 3/16 inch so as to provide an open area of approximately 41% of the total area of the screen. The perforations in screen member 54 permit the liquid phase of the waste material and flushing fluid 78 to pass therethrough while impeding the transfer of the solid phase waste material.

When the waste matter and flushing fluid arrive from the waste inlet 28, screen member 54 prevents the solid waste from entering the region of the tank opposite the waste inlet. It can be seen, therefore, that screen member 54 acts as a partition which divides the solid phase waste matter from the liquid phase waste matter, with substantially all of the solid phase waste matter being excluded from the interior of the screen member 54, with substantially only liquid phase waste matter and flushing fluid 78 within the screen member 54.

The subject invention utilizes a recirculating fluid 78 for a flushing medium rather than water. Such fluids are well known in the sanitation art. The nonaqueous flushing fluid 78 is a hydrophobic substance, somewhat lighter than water, having a specific gravity in the range of approximately 0.8. As shown in FIG. 2, the fluid 78 separates from the waste material and will not mix with either the solid phase waste or the liquid phase waste. A flushing fluid comprised of a blend of highly refined mineral oil and various additives such as deodorizers, dyes and microbiocides has been found to be ideal, although other substances such as unscented kerosene can be used instead of mineral oil in emergencies.

The flushing fluid 78 travels through a closed-loop path. When the toilet 22 is flushed, the fluid acts as a carrier for transporting the waste matter with the aid of gravity from the toilet to the holding tank 20. It is necessary, therefore, to retrieve the flushing fluid from the tank 20 so that it can be reused in subsequent flushings. As can best be seen in FIG. 2, the material that enters the storage tank quickly separates into various components with the solid phase of the waste material being deposited outside screen 54 over tank waste outlet 48 and a fraction of the liquid phase material and flushing fluid passing through the screen 54 into the remainder of the tank. As previously noted, the lightweight flushing fluid will not mix with the waste material, but will instead rise to the surface of the material so as to form a stratified layer 78 of fluid. The quantity of fluid presnet is preferably such that a 2 to 3 inch layer is formed.

The subject system includes a flushing fluid pickup float 94 disposed within the fluid layer 78 in the liquid waste compartment which is used for retrieving the fluid from the tank. FIGS. 2, 3, 4 and 5 show the details of the pickup float 94 which includes two rectangular-shaped sections 90 and 92. The sections are separated by four spacers 102 so as to form a space or plenum 80 between the sections. Plenum 80 is preferably ⅝ inch thick. A tubular pickup float cover 106 is used to secure the float sections 90 and 92 together. Cover 106 has preferably three openings substantially the width of plenum 80, each opening slightly less than a 120° arc segment of the cover.

Figure 5:
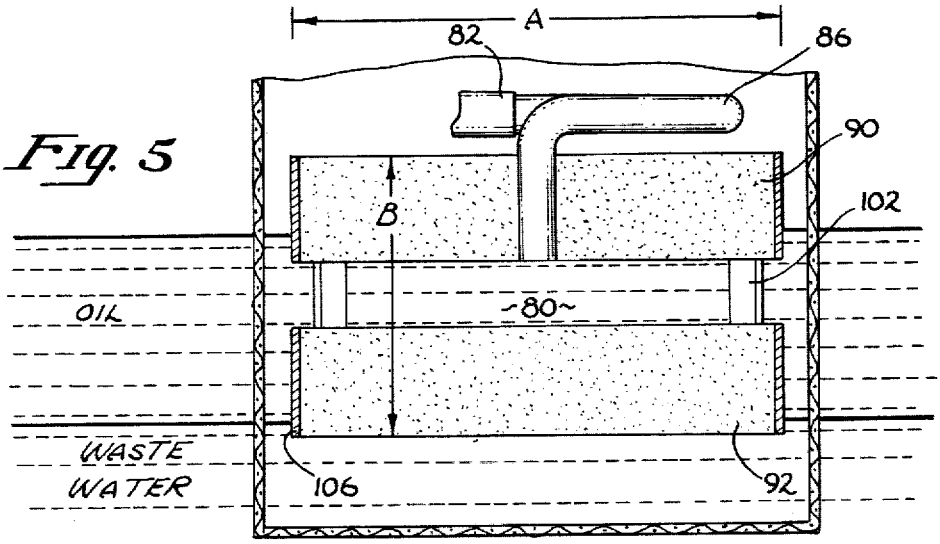
FIG. 5 is a fragmentary side view of the pickup float taken along line 5—5 of FIG. 4.
Figure 6:
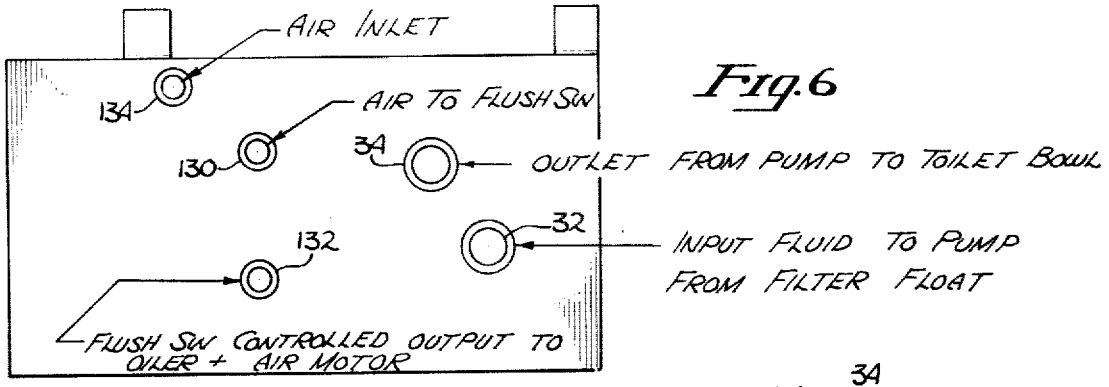
FIG. 6 is a top plan view of the air pump means housing.
Figure 7:
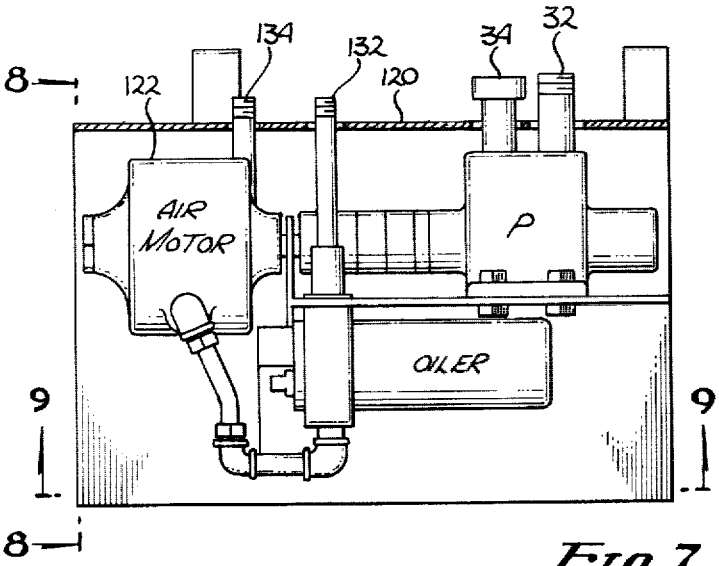
FIG. 7 is an elevational view of the air pump system.
Figure 8:
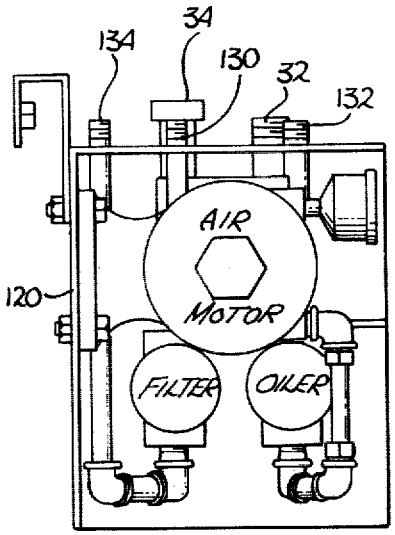
FIG. 8 is an elevational view of the air motor taken along line 8—8 of FIG. 7.
Figure 9:
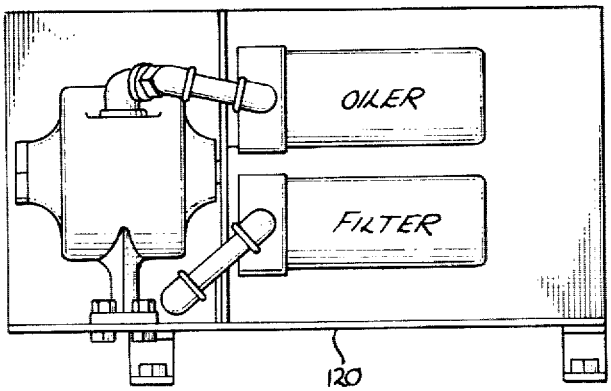
FIG. 9 is a bottom view of the air motor taken along line 9—9 of FIG. 7.

As can best be seen in FIGS. 1, 2, and 5 one end of an elbow 86 is secured within upper float section 90 with the other end being attached to a coiled hose 82. The opposite end of hose 82 is attached to a junction tube 96 mounted through the side of housing 88. The input of a means for supplying flushing fluid to the toilet, preferably a pump means 36 for pumping flushing fluid mounted adjacent to the side of tank 20, is connected to the other end of junction tube 96 through a flushing fluid line 32. The output of pump means 36 is in turn connected to toilet bowl 66 through a flushing fluid inlet line 34. Pump means 36 is preferably an air pump powered by compressed air. Air pumps, which are well known in the art, are particularly suitable on large vehicles such as buses which utilize compressed air for braking purposes. Alternatively, electric pumps of either the A.C. or D.C. variety may be used in applications where compressed air is not readily available.

When toilet 22 is flushed by depressing flush button 24, switch 26 is activated, causing pump means 36 to pump flushing fluid from plenum 80 of the pickup float through the upper float section 90, through coiled hose 82 and then into the toilet bowl 66 by line 34. Pump means 36 continues to pump flushing fluid 78 to the toilet bowl 66 as long as flush button 24 is depressed. When flushing is completed, flush button 24 is released and pump switch 26 is deactivated, causing delivery of fluid to the bowl 66 to cease. However, pump means 36 continues to pump for a short period following deenergization and delivers a small amount of fluid 78 to bowl 66.

Float 94 remains suspended in the flushing fluid strata 78 regardless of the amount of waste contained in the tank. When the waste level is low, the pickup float 94 is disposed near the lower section of tank 20, thereby causing the coiled hose 82 to expand. As the waste level increases, float 94 rises, permitting coiled hose 82 to contract. A housing 88 is constructed in the tank 20 top over the float to receive a portion of the contracted hose when the tank is almost filled. As can best be seen in FIG. 2, the walls of tank 20 and panel member 54 limit lateral movement of float 94 so that the float is always properly positioned below housing 88.

For satisfactory operation of the system, it is important that the fluid delivered to the bowl contain no waste matter. The present system incorporates many features which insure that only flushing fluid is delivered. One common problem encountered in prior art waterless toilets is the presence of toilet paper or other paper products in the tank. Paper is light and will often float on the surface of the waste material within the fluid strata, thereby causing the plenum 80 eventually to clog. This problem is avoided in the present system since screen member 54 prevents any solid matter such as paper from passing into the liquid phase compartment of the tank where pickup float 94 is disposed.

In order to avoid picking up any of the liquid wastes 56, it is important that the float 94 be centered in the strata of flushing fluid 78. The weight of the float 94 and therefore the density can be adjusted by adjusting the weight of the pickup float cover 106. The pickup float cover 106 is preferably metal such as stainless steel or steel with a suitable coating (e.g., plastic) to prevent corrosion. Pick up float cover 106 also compensates for the upward force created by the contraction of coiled hose 82. The weight of float 94 can also be adjusted by varying the amount and composition of float material in the upper float 90 and lower float 92 sections, which are preferably comprised of nylon, wood, closed cell-foam, or a silicone foam material (for example, SILASTIC-RTV Silicone made by General Electric) filled with glass or plastic microspheres or microballoons to obtain the desired density. Obviously, the upward force created by the hose when the waste level in the tank is relatively low and the coiled hose 82 expanded is greater than the force exerted when the tank is full and the hose contracted. In order to minimize the effect of the change in force which causes the float 94 to change its position within the fluid strata 78, coiled hose 82 should be constructed in a manner such that the change in force will be small. This can be accomplished by constructing a coiled hose which exerts a relatively small force so that the change in force will accordingly be small. A coiled hose made of a relatively inflexible tubing which is long relative to the required displacement of the float is ideal. The length of the tubing can be confined to a relatively small volume by employing several turns, each of which is large in diameter, as shown in FIG. 2. It has been found that a suitable coiled hose can be made from polyethylene a polyproplyene tubing which is heated and then coiled around an appropriately shaped mandrel to create the spring-like shape. Once formed in this fashion, the polyethylene retains in its "memory" the shape of the mandrel and as such acts as a spring which, when extended, tends to contract. The contracting force offsets the weight of the coiled hose when the hose is filled with flushing fluid. This novel feature thus provides, in effect, a very low rate spring which is ideal for use in the flushing fluid pickup mechanism.

Agitation of the material in the tank 20 has a tendency to cause some of the waste material to become temporarily mixed with the flushing fluid layer 78. Such agitation occurs when toilet 66 is flushing both because of the material entering the tank and the small quantity of fluid being taken up for flushing purposes. Similarly, agitation will occur in mobile applications when the vehicle is under way. The effects of agitation caused by material entering the tank is minimized by disposing the pickup float 94 and the waste inlet 28 on opposite sides of the tank. Furthermore, float 94 serves to dampen the motion of the flushing fluid in the vicinity of the float so that there will be a lesser tendency for the flushing fluid and waste to mix at that point. Also, the plenum 80 from which the fluid is drawn is shielded by the pickup float cover 106, and therefore the fluid used for flushing is freer of foreign substances and is less agitated than the fluid outside the plenum. In any event, there will invariably be a small quantity of waste material mixed with the flushing fluid and vice-versa. The waste material which mixes with the fluid in the fluid strata will tend to form an emulsion. The presence of the emulsion, however, does not adversely affect the flushing capabilities of the system due, in part, to the fact that the solid phase waste matter is prevented from entering the liquid waste compartment where the pickup float 94 is located.

The level of waste material in tank 20 can be determined by viewing a transparent sight gage 40 attached to the lower section of the tank. The gage 40 is a preferred means for detecting not only the waste level 50, but also the flushing fluid level 52. When the tank is full, a discharge hose from either a vacuum pump truck, a larger stationary holding tank or a sewer line is connected to the waste outlet 114 of a slide valve 44, connected to outlet 48. Slide valve 44 is manually operated by means of handle 46. When the valve 44 is opened by pulling handle 46 outwardly, the waste material exits the tank. The solid phase waste material is generally lowest in the tank 20, so that this material exits the tank first, followed by the liquid phase matter. This sequence is advantageous since the liquid phase matter acts as a flushing agent which tends to thoroughly flush the solid phase matter from the tank and screen member 54.

Flushing fluid 78 is used repeatedly, therefore the fluid is normally retained when the tank is emptied. This may be accomplished by observing the sight gage 40 and shutting off slide valve 44 when the waste level 50 approaches the bottom of the gage. Sight gage 40 is preferably mounted in the toilet system so that it may be observed by the operator during the emptying of the tank 20. For example, in some mobile applications the gage is mounted in the interior of the vehicle, while the slide valve 44 is operated from the outside. In this case, it would be preferable to have sight gage 40 visible through an access plate or other access means, in close proximity to handle 46.

It can best be seen from FIGS. 6–9 that the preferred pump means 36 comprises an air motor 122 engaged with a flushing fluid pump 124. Air inlet 134 is connected to and delivers compressed air from the compressed air supply source of the vehicle to a filter means 128 connected to a first air line 130 connected to the pump switch 26. A second air line 132 exiting from the pump switch 26 is connected to and delivers compressed air to the oiler means 126 and to the air motor 122. Filter means 128 is a means for removing particulate matter and other contaminants from the compressed air before it is delivered to the pump switch 26 and thereafter the air motor 122. The oiler means 126 is a means for lubricating the air motor. Typically the oiler means 126 comprises a lubricator pump which delivers a small quantity of oil in droplets to the air supply of the air motor 122 in order to reduce internal friction. Pump means 36 is supported and protected by a pump means housing plate 120, which is attached to the vehicle.

There has been described herein a novel waterless flush toilet system which is of simple construction and which provides trouble-free operation. It is to be understood, however, that while one specific embodiment of the present invention has been disclosed and described in detail herein, various changes in form and detail could be made by those skilled in the art without departing from the spirit and scope of the invention.

I claim:

1. In a waterless flushing toilet system including a toilet, a waste holding tank having a waste inlet and a waste outlet, a supply of nonaqueous flushing fluid stored in said holding tank, said fluid being lighter than and substantially insoluble in water, so that a stratified layer of said fluid is formed on the upper surface of the waste material held in the tank, an improvement comprising:

a flushing fluid pickup device disposed in said tank for removing a quantity of flushing fluid from said tank to be delivered to said toilet for flushing purposes, said flushing fluid pickup device comprising:

a pickup float which floats within said liquid waste compartment, said pickup float having at least one flushing fluid inlet disposed within said layer of flushing fluid, said pickup float having an upper pickup float member, and a lower pickup float member coupled to and spaced-apart from said upper member, said upper and lower members defining a plenum containing flushing fluid with said at least one flushing fluid inlet being disposed in said plenum whereby said flushing fluid which is supplied to said toilet is drawn from said flushing fluid within said plenum; and a hose having a first end coupled to said pickup float and in communication with said flushing fluid inlet and a second end coupled to a means for supplying said flushing fluid to said toilet wherein said pickup float is suspended by said hose and said hose is substantially in the form of a coil;

a perforated screen member disposed in said tank which divides said tank into a solid waste compartment and a liquid waste compartment, with said waste inlet and outlet being disposed in said solid waste compartment, and with said fluid pickup device disposed in said liquid waste compartment, whereby solid and liquid waste arriving from said toilet through said waste inlet are deposited in said solid waste compartment, with said screen member impeding transfer of the solid phase waste from the solid waste compartment to said liquid waste compartment where said flushing fluid is picked up by said pickup device.

2. The improvements of claim 1 wherein said hose acts as a spring and said pickup float further includes a tubular pickup float cover to couple said upper and lower pickup float members together, said cover having a surface defining a plurality of openings substantially the width of said plenum, and said cover having a weight counteracting a contraction force created by said hose.

3. In a waterless flushing toilet system including a toilet, a waste holding tank having a waste inlet and a waste outlet, a supply of a nonaqueous flushing fluid stored in said holding tank, said fluid being lighter than and substantially insoluble in water, so that a stratified layer of said fluid is formed on the upper surface of the waste material held in the tank and a flushing fluid pickup device disposed in said tank for removing a quantity of flushing fluid from said tank to be delivered to said toilet for flushing purposes, an improvement comprising:

a perforated screen member disposed in said tank which divides said tank into a solid waste compartment and a liquid waste compartment, with said waste inlet and outlet being disposed in said solid waste compartment, and with said fluid pickup device disposed in said liquid waste compartment, whereby solid and liquid waste arriving from said toilet through said waste inlet are deposited in said solid waste compartment, with said screen member impeding transfer of the solid phase waste from the solid waste compartment to said liquid waste compartment where said flushing fluid is picked up by said pickup device; and means for exhausting air and vapors from said toilet wherein said toilet has an inner wall and an outer wall defining an interstitial region between said walls, said inner wall having a surface defining an inner wall opening at the lower extremity of said inner wall, said outer wall having a surface defining a toilet exit pipe coupled to said waste holding tank, and said outer wall surface further defining an exhaust opening substantially above the level of said inner wall opening, said exhaust opening being coupled to said means for exhausting air and vapors, whereby said means for exhausting air and vapors from said toilet may exhaust air and vapors without exhausting waste matter or flushing fluid.

4. In a waterless flushing toilet system including a toilet, a waste holding tank having a waste inlet and a waste outlet, a supply of a nonaqueous flushing fluid stored in said holding tank, said fluid being lighter than and substantially insoluble in water, so that a stratified layer of said fluid is formed on the upper surface of the waste material held in the tank and a flushing fluid pickup device disposed in said tank for removing a quantity of flushing fluid from said tank to be delivered to said toilet for flushing purposes, an improvement comprising:

a perforated screen member disposed in said tank which divides said tank into a solid waste compartment and a liquid waste compartment, with said waste inlet and outlet being disposed in said solid waste compartment;

wherein said pickup device comprises a pickup float disposed within said liquid waste compartment, said pickup float having at least one flushing fluid inlet disposed within said layer of flushing fluid and a hose having a first end coupled to said pickup float and in in communication with said at least one fluid inlet and a second end coupled to a means for supplying said flushing fluid to said toilet;

whereby solid and liquid waste arriving from said toilet through said waste inlet are deposited in said solid waste compartment, with said screen member impeding transfer of the solid phase waste from the solid waste compartment to said liquid waste compartment where said flushing fluid is picked up by said pickup device.

5. The improvement of claim 4 further comprising a means for exhausting air and vapors from said toilet.

6. The improvement of claim 4 further comprising a means for detecting the level of said waste matter and the level of said flushing fluid in said waste holding tank.

7. The improvement of claim 6 wherein the means for detecting the level of said waste matter and the level of said flushing fluid in said waste holding tank is a sight gage coupled to said tank.

8. The improvement of claim 4 wherein said hose is substantially in the form of a coil and acts as a spring, and said pickup float comprises:

an upper pickup float member;

a lower pickup float member coupled to and spaced-apart from said upper member, said upper and lower members defining a plenum containing flushing fluid with said at least one flushing fluid inlet being disposed in said plenum;

a tubular pickup float cover coupling said upper and lower pickup float members together, said cover having a surface defining openings substantially the width of said plenum, each said opening being slightly less than a 120 degree are segment of said cover, and said cover having a weight counteracting a contraction force created by said hose.

9. The improvement of claim 4 wherein said means for supplying said flushing fluid to said toilet comprises a means for pumping flushing fluid.

10. The improvement of claim 4 wherein said means for supplying said flushing fluid to said toilet includes a manually-actuated means for flushing said toilet, and an air motor pump which is responsive to said manually-actuated means for flushing said toilet.

11. The improvement of claim 5 wherein said means for exhausting air and vapors from said toilet includes an exhaust fan connected to said toilet and further connected to an exhaust exit, whereby said exhaust fan may draw air and vapors from said toilet and expel said air and vapors out the exhaust exit.

12. In a waterless flushing toilet system including a toilet, a waste holding tank having a waste inlet and a waste outlet, a supply of a nonaqueous flushing fluid stored in said holding tank, said fluid being lighter than and substantially insoluble in water, so that a stratified layer of said fluid is formed on the upper surface of the waste material held in the tank, and a flushing fluid pickup device disposed in said tank for removing a quantity of flushing fluid from said tank to be delivered to said toilet for flushing purposes, an improvement comprising:

a perforated screen member disposed in said tank which divides said tank into a solid waste and a liquid waste compartment with said waste inlet and outlet being disposed in said solid waste compartment and said fluid pickup device being disposed in said liquid waste compartment;

wherein said flushing fluid pickup device is a pickup float which floats within said liquid waste compartment, said float comprising an upper pickup float member and a lower pickup float member coupled to and spaced apart from said upper member, said upper and lower members defining a plenum containing flushing fluid with at least one flushing fluid inlet being disposed in said plenum; and a hose having a first end coupled to said pickup float and in communication with said at least one flushing fluid inlet and a second end coupled to a means for supplying said flushing fluid to said toilet, said hose being substantially in the form of a coil with said pickup float being suspended by said hose;

whereby solid and liquid phase waste arriving from said toilet through said waste inlet is deposited in said solid waste compartment with said partition impeding the transfer of the solid phase waste from said solid waste compartment to said liquid waste compartment where said flushing fluid is picked up by said pickup float and delivered to said toilet through said hose.

13. The improvement of claim 12 further comprising a means for exhausting air and vapors from said toilet, wherein said means for exhausting air and vapors from said toilet includes an exhaust fan connected to said toilet and further connected to an exhaust exit, whereby said exhaust fan may draw air and vapors from said toilet and expel said air and vapors out the exhaust exit.

14. The improvement of claim 13 wherein said toilet has funnel-shaped inner wall and a funnel-shaped outer wall defining an interstitial region between said walls, said inner wall having a surface defining an inner wall opening at the lower extremity of said inner wall, said outer wall having a surface defining a toilet exit pipe coupled to said waste holding tank, and said outer wall surface further defining an exhaust opening substantially above the level of said inner wall opening, said exhaust opening being coupled to said means for exhausting air and vapors, whereby said means for exhausting air and vapors from said toilet may exhaust air and vapors without exhausting waste matter or flushing fluid.

15. The improvement of claim 12 wherein said means for supplying said flushing fluid to said toilet includes a manually-actuated means for flushing said toilet, and an air motor pump which is responsive to said manually-actuated means for flushing said toilet.

16. The improvement of claim 12 further comprising a sight gage coupled to said waste holding tank, for detecting the level of said waste matter and flushing fluid levels in said tank.

* * * * *